US007810192B2

(12) United States Patent
Fujita et al.

(10) Patent No.: US 7,810,192 B2
(45) Date of Patent: Oct. 12, 2010

(54) HEAD SUPPORT PILLOW

(75) Inventors: Minoru Fujita, Kobe (JP); Ryoko Murotani, Imizu (JP)

(73) Assignee: Foot Techno Inc., Hyogo-Ken (JP)

( * ) Notice: Subject to any disclaimer, the term of this patent is extended or adjusted under 35 U.S.C. 154(b) by 0 days.

(21) Appl. No.: 11/885,800

(22) PCT Filed: Dec. 27, 2006

(86) PCT No.: PCT/JP2006/326057

§ 371 (c)(1),
(2), (4) Date: Sep. 6, 2007

(87) PCT Pub. No.: WO2007/074867

PCT Pub. Date: Jul. 5, 2007

(65) Prior Publication Data

US 2008/0155752 A1 Jul. 3, 2008

(30) Foreign Application Priority Data

Dec. 28, 2005 (JP) ..... 2005-379940

(51) Int. Cl.
*A47C 20/00* (2006.01)

(52) U.S. Cl. ..... 5/636; 5/638; 5/652.1; 5/730; 297/397

(58) Field of Classification Search ..... 5/622, 5/636, 733, 637, 645, 638, 724, 725, 730, 5/652, 652.1; 248/118; 297/391, 452.15; D6/601
See application file for complete search history.

(56) References Cited

U.S. PATENT DOCUMENTS 4,060,863 A * 12/1977 Craig ..... 5/644
4,688,780 A * 8/1987 Hanz ..... 5/621
5,018,231 A 5/1991 Wang
5,163,194 A 11/1992 Dixon
5,214,814 A 6/1993 Eremita et al.
D342,410 S * 12/1993 Boyd ..... D6/601
D363,403 S * 10/1995 Dixon ..... D6/597

(Continued)

FOREIGN PATENT DOCUMENTS

JP 40-30602 Y1 10/1965

(Continued)

OTHER PUBLICATIONS

International Search Report PCT/JP2006/326057, Jan. 19, 2007.

(Continued)

*Primary Examiner*—Robert G Santos
*Assistant Examiner*—Nicholas Polito
(74) *Attorney, Agent, or Firm*—Pearl Cohen Zedek Latzer, LLP

(57) ABSTRACT

A pillow having a pillow body including a flat cushion and a flexible cover covering the surface of the pillow body. The pillow body includes a central portion defining a back head support and side head supports located on left and right sides of the back head support. The back head support includes a first slit extending in a widthwise direction and a second slit and a third slit extending so as to be inclined relative to the first slit.

6 Claims, 9 Drawing Sheets

U.S. PATENT DOCUMENTS

| | | | | | |
|---|---|---|---|---|---|
| D385,741 | S | * | 11/1997 | Lebenbaum | D6/601 |
| 5,778,469 | A | * | 7/1998 | Festa | 5/640 |
| 5,781,947 | A | * | 7/1998 | Sramek | 5/636 |
| 6,038,719 | A | | 3/2000 | Castagna | |
| 6,547,327 | B1 | * | 4/2003 | Yates | 297/214 |
| 2002/0050007 | A1 | * | 5/2002 | Kim | 5/636 |

FOREIGN PATENT DOCUMENTS

| | | | |
|---|---|---|---|
| JP | 05-018367 | U | 3/1993 |
| JP | 11-004740 | A | 1/1999 |
| JP | 2000-253977 | | 9/2000 |
| JP | 3075201 | U | 2/2001 |
| JP | 2005-6920 | A | 1/2005 |
| JP | 3109464 | U | 5/2005 |

OTHER PUBLICATIONS

Translation of the International Preliminary Report on Patentabiliy for application No. PCT/JP2006/326057, dated Jul. 21, 2008.
Search Report issued in EP Application 06843439 on Jan. 8, 2010.

* cited by examiner

HEAD SUPPORT PILLOW

CROSS-REFERENCE TO RELATED APPLICATIONS

This application is a National Phase Application of PCT International Application No. PCT/JP2006/326057, International Filing Date Dec. 27, 2006, claiming priority of Japanese Patent. Application, 2005-379940, filed Dec. 28, 2005

FIELD OF THE INVENTION

The present invention relates to a pillow that enables a sleeping person to roll over smoothly and stably hold the head even when the position of the head changes as the sleeping person rolls over.

BACKGROUND OF THE INVENTION

In the prior art, as a pillow that enables a person to sleep properly, patent document 1 discloses a pillow having the following structure. The pillow includes a back head fit line arranged in the widthwise direction to stably hold the back of the head at the middle of a head support portion. A neck support portion is arranged at a lower side of the head support portion. Further, the pillow includes side portions arranged at the left and right sides of the head support portion and the neck support portion. The lower peripheral parts of the two side portions form a shoulder fit line. The support portions and the side portions are each bag-like and are filled with fillings such as wool knops, piping material, and beads material.

In such a pillow, the back head fit line formed in the head support portion improves the support of the head with the pillow and enables smooth movement of the head when a sleeping person rolls over. Further, the shoulder fit line enables the pillow to fit with the shoulder line. Thus, an integral feel with the pillow and mental relaxation can be expected.

In the above pillow of the prior art, the back head fit line is formed by joining the front and rear covers of the head support portion in the widthwise direction so as to form a constricted part with a narrow and shallow groove. Fillings do not exist in the portion corresponding to the back head fit line. Further, this portion is not resilient. Accordingly, the above prior art pillow does not function to sufficiently support the head. Further, the head support portion does not deform sufficiently so as to follow movement of the head in the left and right directions. Thus, a sleeping person cannot smoothly move his or her head when rolling over. Further, in the above prior art pillow, the two side portions are higher than the head support portion and the neck support portion. This makes it difficult for a sleeping person to roll over smoothly. Moreover, the side of the head is only supported by the upper surface of the side portions when a sleeping person rolls over. Thus, the side of the head cannot be stably supported.

Patent Document 1: Registered Utility Model No. 3109464

SUMMARY OF THE INVENTION

It is an object of the present invention to provide a pillow that stably supports the back of the head and the side of the head while enabling a sleeping person to roll over smoothly.

To achieve the above object, one aspect of the present invention is a pillow having a pillow body including a flat cushion and a flexible cover covering the surface of the pillow body. The pillow body includes a central portion defining a back head support and side head supports located on left and right sides of the back head support. The back head support includes a first slit extending in a widthwise direction and a second slit and a third slit extending so as to be inclined relative to the first slit.

DETAILED DESCRIPTION OF INVENTION

A pillow according to one embodiment of the present invention will now be described with reference to FIGS. 1 and 11.

Figure 1:
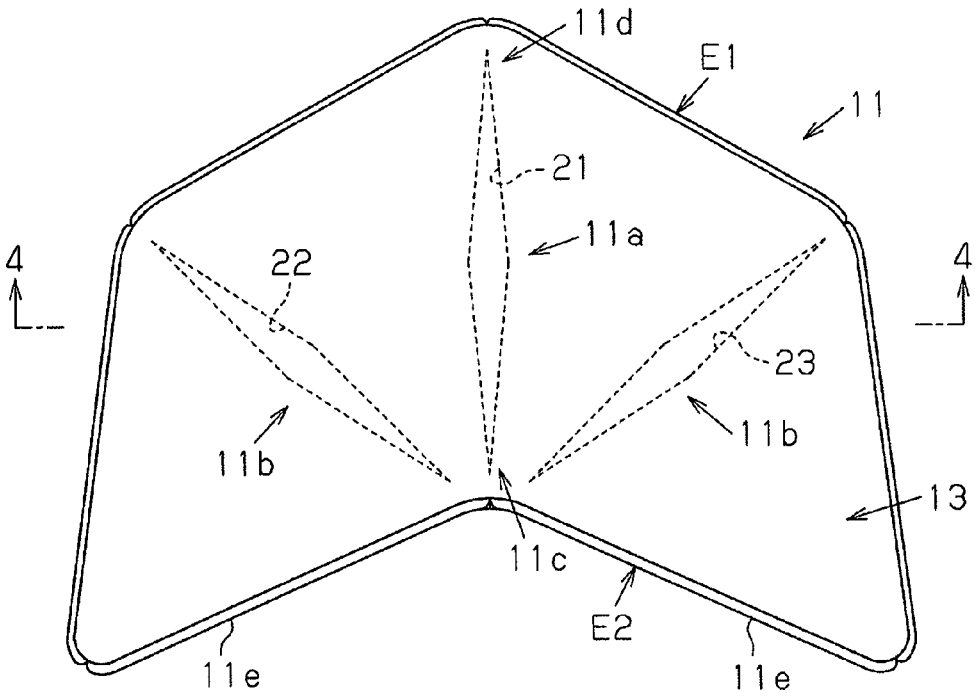
FIG. 1 is a front view showing a pillow according to one embodiment of the present invention.
Figure 2:
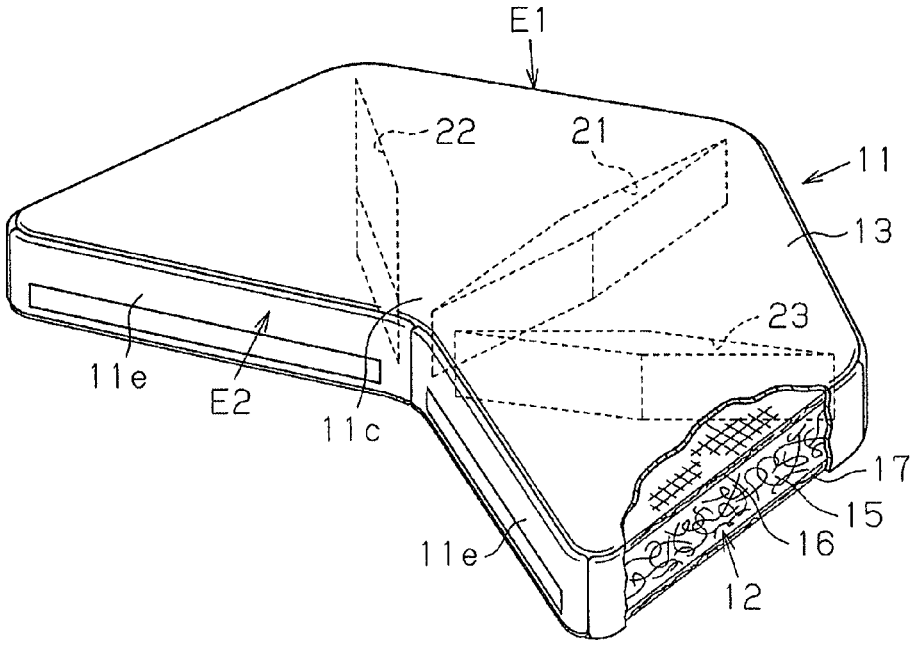
FIG. 2 is a partially cutaway perspective view showing the pillow of FIG. 1.
Figure 3:
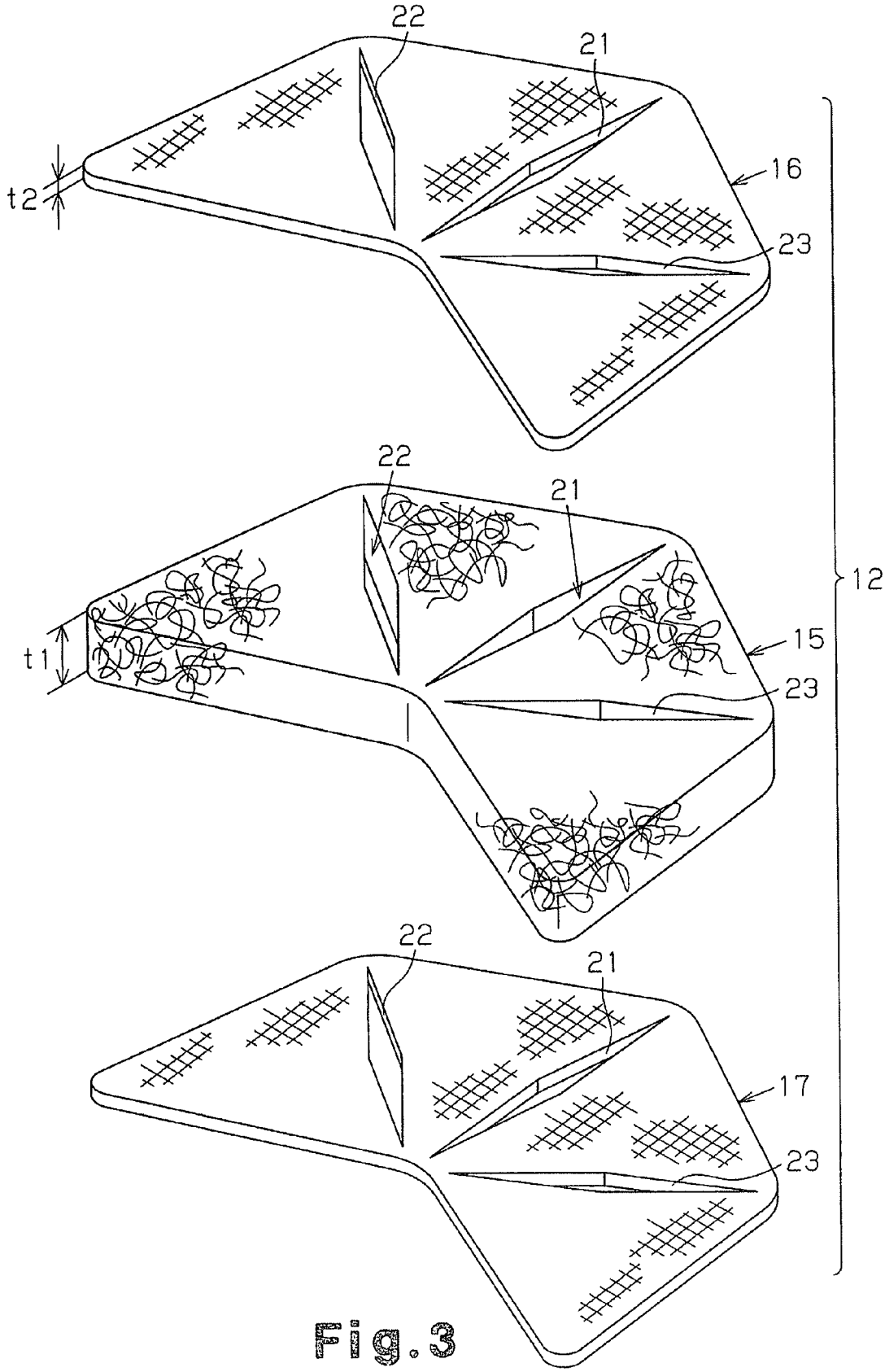
FIG. 3 is a perspective view showing first to third cushions of a pillow body in a separated state.
Figure 4:
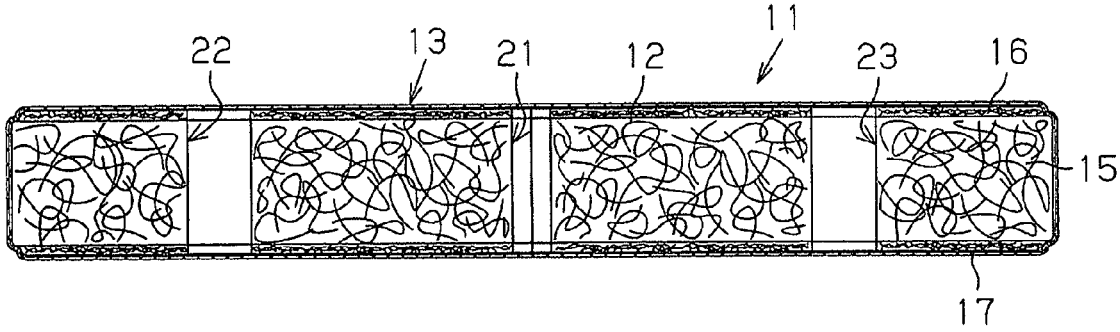
FIG. 4 is an enlarged cross-sectional view taken along line 4-4 in FIG. 1.

As shown in FIG. 2, a pillow 11 has entirely the same thickness and has a flat shape. The pillow 11 includes a pillow body 12, which is covered by a cover 13. Referring to FIG. 3, the pillow body 12 includes a first cushion 15, which is formed by a high repulsion resilient material, and second and third cushions 16 and 17, which serve as sub-cushions that are respectively come in contact with the upper and lower surfaces of the first cushion 15. A first slit 21, which has the shape of a flat diamond elongated in the widthwise direction when viewed from above, is formed in the middle portion of each of the first to third cushions 15 to 17. Second and third slits 22 and 23, which have the shape of a flat diamond, are formed in the left and right portions of each of the first and third cushions 15 to 17 in an inclined state so as to be farther from the first slit 21 as the upper end becomes closer as shown in FIG. 1. In this specification, the end face located at the side of the pillow 11 that is closer to the top of the head as viewed in FIG. 1 is defined as the upper end face E1 and the end face located at the side closer to the shoulder is defined as the lower end face E2.

As shown in FIG. 1, a back head support 11*a* is formed in the central portion of the pillow 11 with respect to the lateral direction. Side head supports 11*b*, 11*b* are formed in the left and right sides of the back head support 11*a*. The lower end face E2 of the pillow 11 is formed to have the shape of a valley as a whole that becomes higher as the central portion becomes closer. The central portion, which is the bottom of the valley, is arcuate. The portion immediately above the arcuate portion defines a first cervical bone support 11*c*. The upper end face E1 of the pillow 11 is formed to have the shape of a ridge as a whole that bulges out and becomes higher as the central portion becomes closer. The bulged portion defines a second cervical bone support lid. Inclined portions at the left and right sides of the lower end face E2 of the pillow 11 respectively define shoulder contacts 11*e* and 11*e*.

The cover 13 has an opening (not shown) at the side of the lower end face E2 so that the pillow body 12 can be placed into and taken out of the cover 13. A double-layer open-close cover having a planar fastener opens and closes the opening.

The material forming the cover 13, the first cushion 15, and the second and third cushions 16 and 17 will now be described.

As the material for the cover 13, a breathable and flexible material such as double russel mesh made of yarns or fibers of polyurethane, polyethel, and nylon; flexible fabric or cloth; or surface material such as a fabric of natural fibers. Material suitable for the cover 13 is breathable and flexible cloth, fabric, or nonwoven fabric.

The first cushion 15 is formed by a breathable high repulsion resilient material. As the high repulsion resilient material, a mat-shaped material having a high porous rate and formed by twisting together polyester fibers having a diameter of 0.3 mm to 1.5 mm (product name: press air, Toyobo Co., Ltd.). Instead of polyester fibers, one type of fiber selected from a synthetic fiber group of resilient polyurethane fibers, polyethylene fibers, polypropylene fibers, and vinyl chloride fibers may be used. Further, a mat made of natural fibers such as resilient coconut hull fibers may be used. Further, for example, at least one type selected from a group of hard mix urethane foam (regenerated urethane foam), urethane foam, rubber sponge, and polyethylene sponge may be used. It is desirable that the mix urethane foam be urethane foam that is harder than normal urethane foam formed by adhering regenerated urethane chips with an adhesive.

The resiliency of the first cushion 15 will now be described with reference to FIG. 5. The resiliency of the first cushion 15 is set so that the compression load is set in the range of 150 N to 300 N, which is required for a 25% compression of a sample having a predetermined length (e.g., 50 to 100 mm) and a diameter of 150 mm. In this embodiment, with the first cushion 15 (press air), the compression load is 200 N/ø150 mm during 25% compression as shown by curve G1 in FIG. 5, and the difference between the compression curve (upper side) and the recovery curve (lower side) is decreased. Thus, the desirable material of the first cushion 15 is press air.

Further, as shown by curve G2, with the hard urethane foam, the compression load is 170 N/ϕ150 mm during 25% compression, and the difference between the compression curve (upper side) and the recovery curve (lower side) is decreased. Thus, the preferable material of the first cushion 15 is hard urethane foam.

Figure 5:
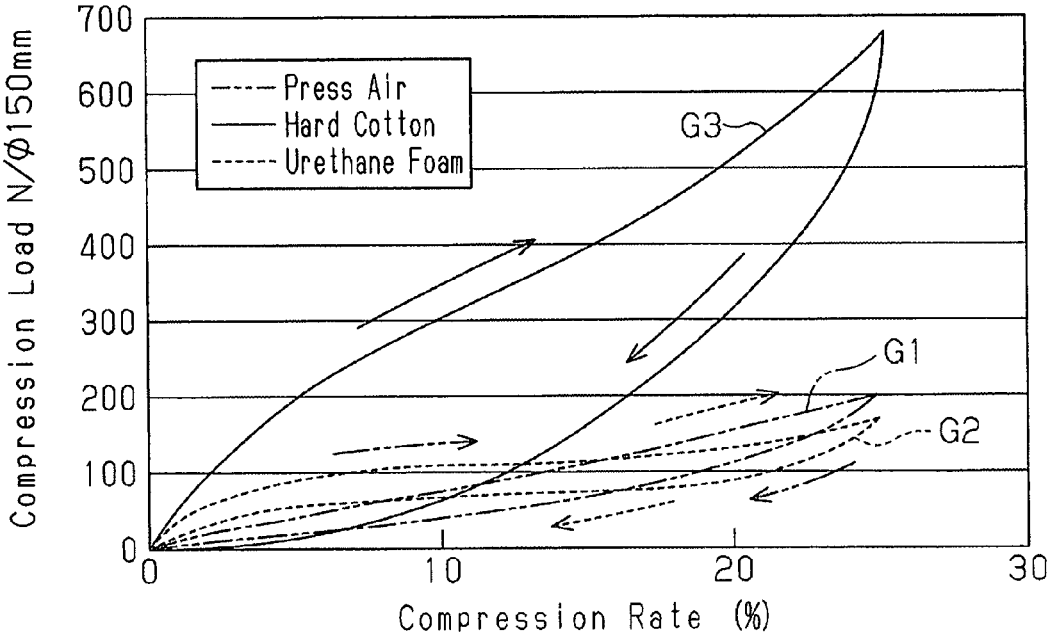
FIG. 5 is a graph illustrating the resilient characteristics of press air, urethane foam, and hard cotton.

With hard cotton, the compression load is 680 N/ϕ150 mm and very high during 25% compression as shown by curve G3 in FIG. 5, and the difference between the compression curve (upper side) and the recovery curve (lower side) is large. Thus, hard cotton is not suitable as the material of the first cushion 15. In summary, the suitable material for the first cushion 15 has high resiliency and a small difference between the compression curve and the recovery curve, that is, superior compression recovery.

The second and third cushions 16 and 17 is made of a soft, breathable, and flexible material, such as a nonwoven fabric mat of felt, a foam body of natural rubber, a foam body of synthetic rubber, a foam body of natural resin, or a foam body of synthetic resin.

Referring to FIG. 3, the first cushion 15 has a thickness t1 set in the range of 20 mm to 150 mm and is set at 50 mm in this embodiment. The second and third cushions 16 and 17 each have a thickness t2 of 2 to 50 mm, and the thickness t2 is set at 5 mm in this embodiment. The appropriate range of the force of resilient recovery for the entire cushion of the pillow differs between users.

Thus, the thickness t1 of the first cushion 15 and the thickness t2 of the second and third cushions 16 and 17 may be adjusted so that, for example, when t1 is 50 mm, t2 is 20 mm, 30 mm, or 40 mm. Further, the first to third slits 21 to 23 each have a length set at 80 to 300 mm, and the length is set at 230 mm in this embodiment. The maximum width at the longitudinally central portion of each of the first to third slits 21 to 23 is set to 2 to 20 mm, and the maximum width is set to 10 mm in this embodiment.

The procedures for using the above pillow 11 will now be described.

Figure 6:
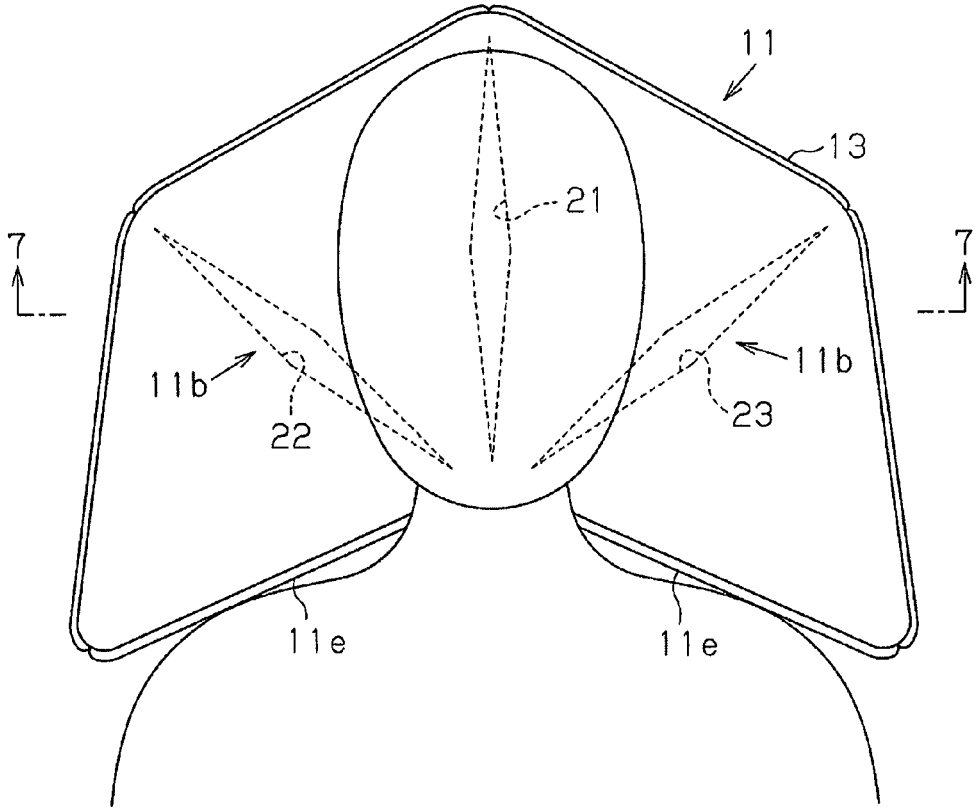
FIG. 6 is a front view showing the pillow in a state of usage.
Figure 7:
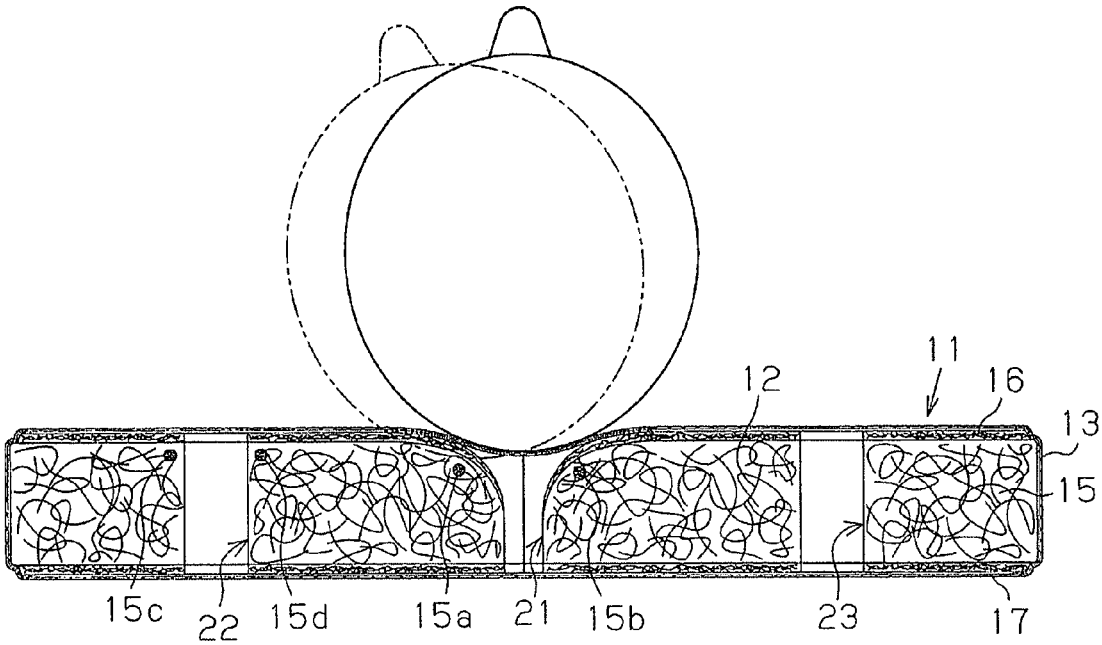
FIG. 7 is an enlarged cross-sectional view taken along line 7-7 in FIG. 6.

As shown in FIG. 6, when a sleeping person facing upward places the rear of his or her head on the back head support 11*a* of the pillow, as shown in FIG. 7, the weight of the head compresses upper rims 15*a* and 15*b* of the first cushion 15 at the left and right sides of the first slit 21. Further, the upper part of the first slit 21 is resiliently deformed in the lateral direction. As a result, the back head support 11*a* stably supports the rear of the head.

The first slit 21, which is compressed and widened by the head, is formed in the back head support 11*a*. Thus, when a person rolls over, for example, when the head turns to the left as indicated by the double-dashed lines is FIG. 7, the upper rim 15*a* of the first cushion 15 at the left side of the first slit 21 is compressed and resiliently deformed. As a result, a sleeping person smoothly rolls over.

Figure 8:
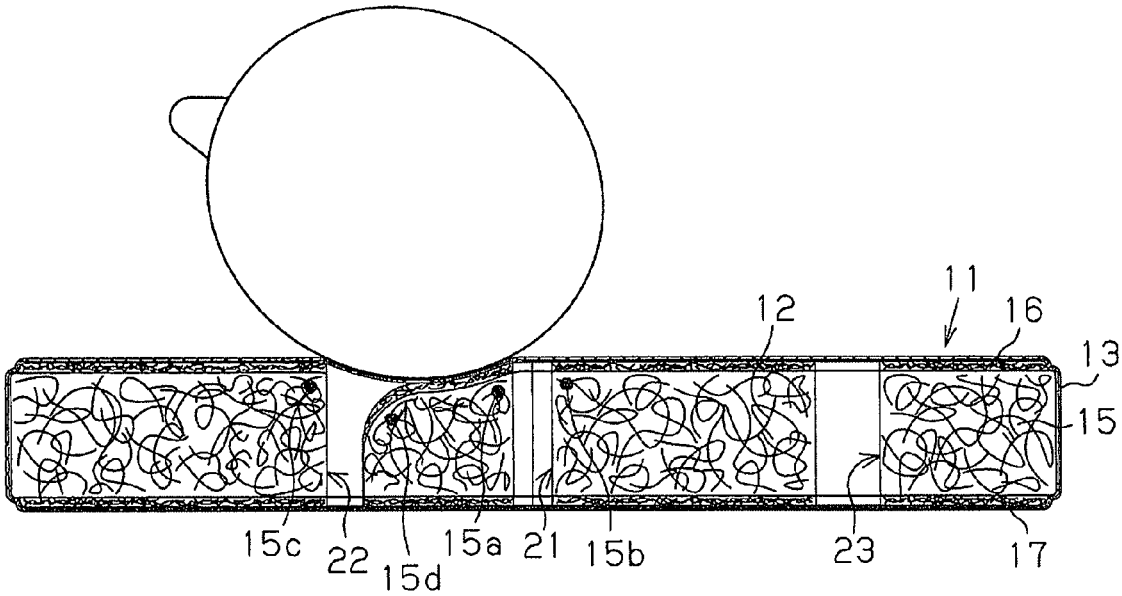
FIG. 8 is a cross-sectional view illustrating a sleeping person rolling over.
Figure 9:
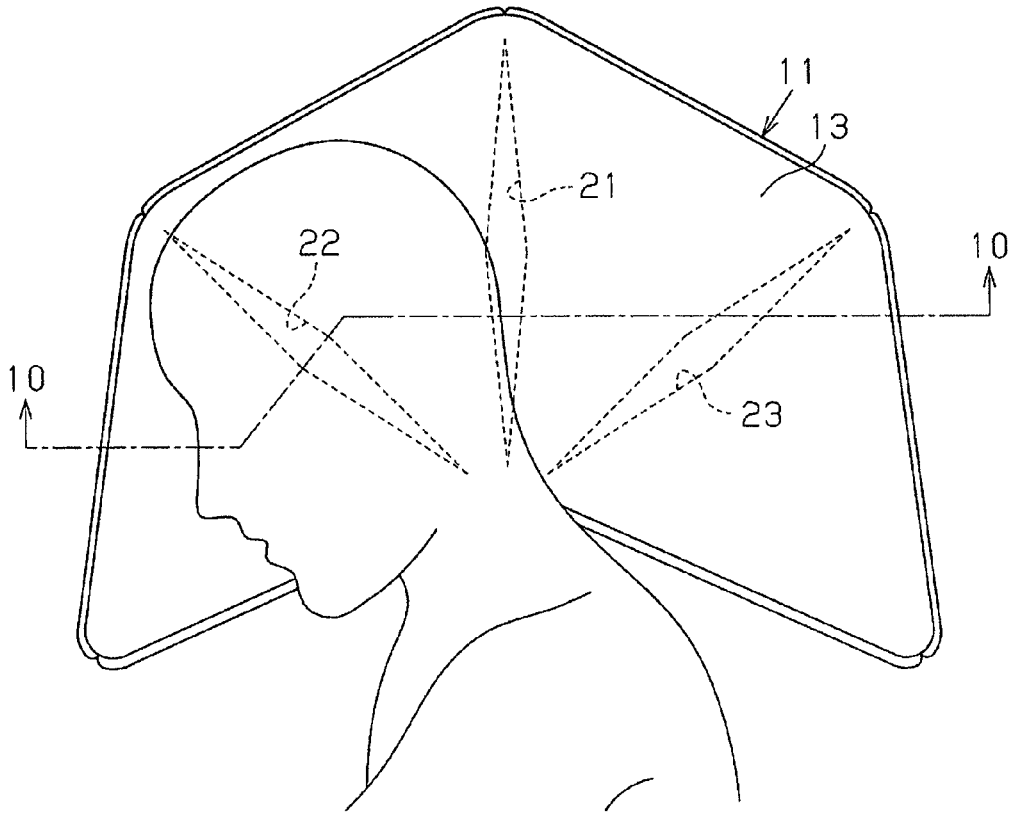
FIG. 9 is a front view showing a state in which a sleeping person ends rolling over.
Figure 10:
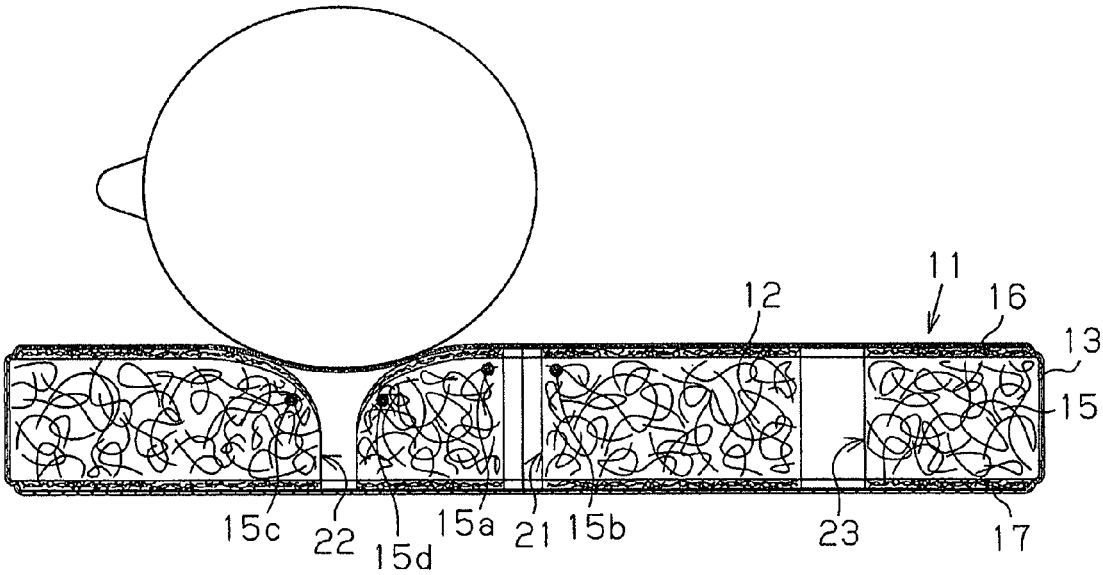
FIG. 10 is an enlarged cross-sectional view taken along line 10-10 in FIG. 9.

Further, referring to FIG. 8, when a sleeping person rolls over from the back head support 11*a* to the side head support 11*b* of the pillow 11, among a pair of left and right rims 15*c* and 15*d* of the second slit 22, the side of the head corresponds to the right upper rim 15*d*. As a result, the upper rim 15*d* is compressed before the left upper rim 15*c*. The upper rim 15*c* applies resistance to the turning of the side of the head, and the head does not advance beyond the proper position. Thus, the side head support 11*b* that corresponds to the second slit 22 stably supports the side of the head as shown in FIGS. 9 and 10. As the side of the head rolls from the side head support 11*b* to the back head support 11*a* and the sleeping person returns to a position where he or she is facing upward as shown in the states of FIGS. 6 and 7, the above described procedures are carried out in a reversed manner so that the sleeping person rolls over smoothly.

Figure 11:
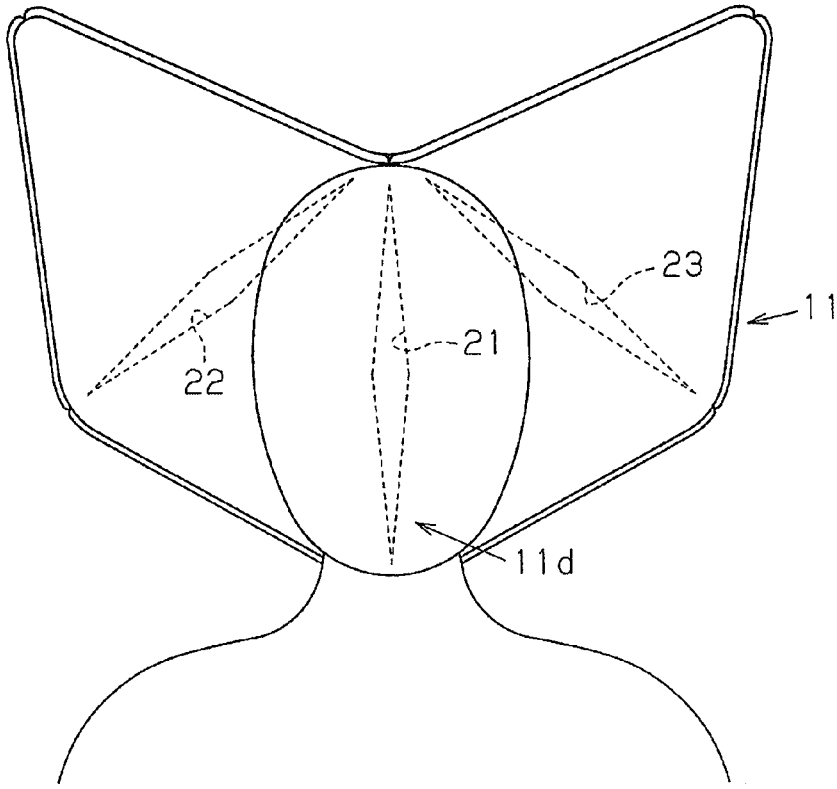
FIG. 11 is a front view showing the pillow in a different state of usage.

As shown in FIG. 11, the pillow 11 may be used upside down. In this case, the second cervical bone support 11*d* supports the entire cervical bone between the neck and torso. This stably supports the head.

As described above in detail, the present embodiment has the advantages described below.

(1) In the present embodiment, the first slit 21 is formed in the central portion of the back head support 11*a*. Accordingly, the rear of the head resiliently deforms the upper rims 15*a* and 15*b* (refer to FIG. 7) of the first cushion 15 at the left and right sides of the first slit 21. This forms a concave recess in the back head support 11*a*. As a result, the back of the head is stably supported. Further, when a sleeping person rolls over such that his or head turns from the position shown by the solid lines in FIG. 7 to the position shown by the double-dashed lines, the left upper rim 15*a* of the first slit 21 is further compressed, and the force of resilient recovery of the right upper rim 15*b* pushes the head. As a result, the sleeping person smoothly rolls over to the left.

(2) In the present embodiment, for example, when the head rolls to the left, just before the side of the head moves to the upper portion of the second slit 22, the upper rim 15*d* of the first cushion 15 is first compressed as shown in FIG. 8 and becomes lower than the upper rim 15*c*. Thus, the head does not turn beyond the second slit 22 and enables the sleeping person to roll over smoothly. Further, the second slit 22 stably supports the side of the head.

(3) In the present embodiment, the pillow body 12 is formed by the first cushion 15 and the second and third cushions 16 and 17 that are breathable in a satisfactory manner. Further, the cover 13 is formed by a breathable and flexible material. Additionally, the first to third slits 21 to 23 are formed in the first to third cushions 15 to 17. This improves the circulation of air in the pillow 11 and disperses the heat from the head in a proper manner thereby enabling a comfortable sleep.

(4) In the present embodiment, the pillow 11 includes the first slit 21. Thus, when the rear of the head is supported by the back head support 11*a*, the weight of the head freely opens the first slit 21. This uniformly applies pressure to the head regardless of where the head is moved to and disperses the pressure. As a result, the pressure applied to the muscles and the sublimis veins at the surface of the head is reduced. The pressure applied to the sublimis veins is said to be normally 32 to 35 mmHg. Thus, the pressure becomes as close as possible to this pressure.

Experimental results show that in the prior art pillow including low repulsion urethane foam in a cover, an average pressure of 68 to 75 mmHg is applied to the head. In the pillow 11 of the present invention, the average pressure is 41 mmHg. As a result, it has been confirmed that the pillow 11 of the present invention reduces the pressure applied to the head when the sleeping person is facing upwards. Further, experimental results show that the dispersion effect of the pressure applied to the head is effective for dispersion the pressure applied to the heel, buttock, and waist.

(5) In the present embodiment, the shoulder contacts 11*e* are arranged at the lower portion of the pillow body 12 to support the shoulders and scapula. This widens the thoracic cage and enables smooth breathing. Thus, the body pressure of the shoulders is lowered in comparison to the prior art pillow. The results of body pressure measurements taken with a body pressure measuring device show that the body pressure of the shoulders with the prior art pillow is 25.8 mmHg, whereas this decreases to 10.3 mmHg when using the pillow 11 of the present invention. Further, an experiment involving a different person shows that this decreased from 26.9 mmHg to 6.4 mmHg.

The bloodstream when using a soft pillow of the prior art formed from low repulsion urethane foam and the bloodstream when using the pillow 11 of the present invention formed from press air (high repulsion resilient material) were measured and the following results were obtained. The measured portion was the temple (frontal lobe) of a subject, the measurement device was NIRO-100 (manufactured by Hamamatsu Photonics Kabushiki Kaisha), and near-infrared spectroscopy was performed to measure the blood concentration (nTHI) at the temple (frontal lobe). After using a pillow in a calm state for a predetermined time, changes in the bloodstream were measured continuously for ten to fifteen minutes.

Figure 12:
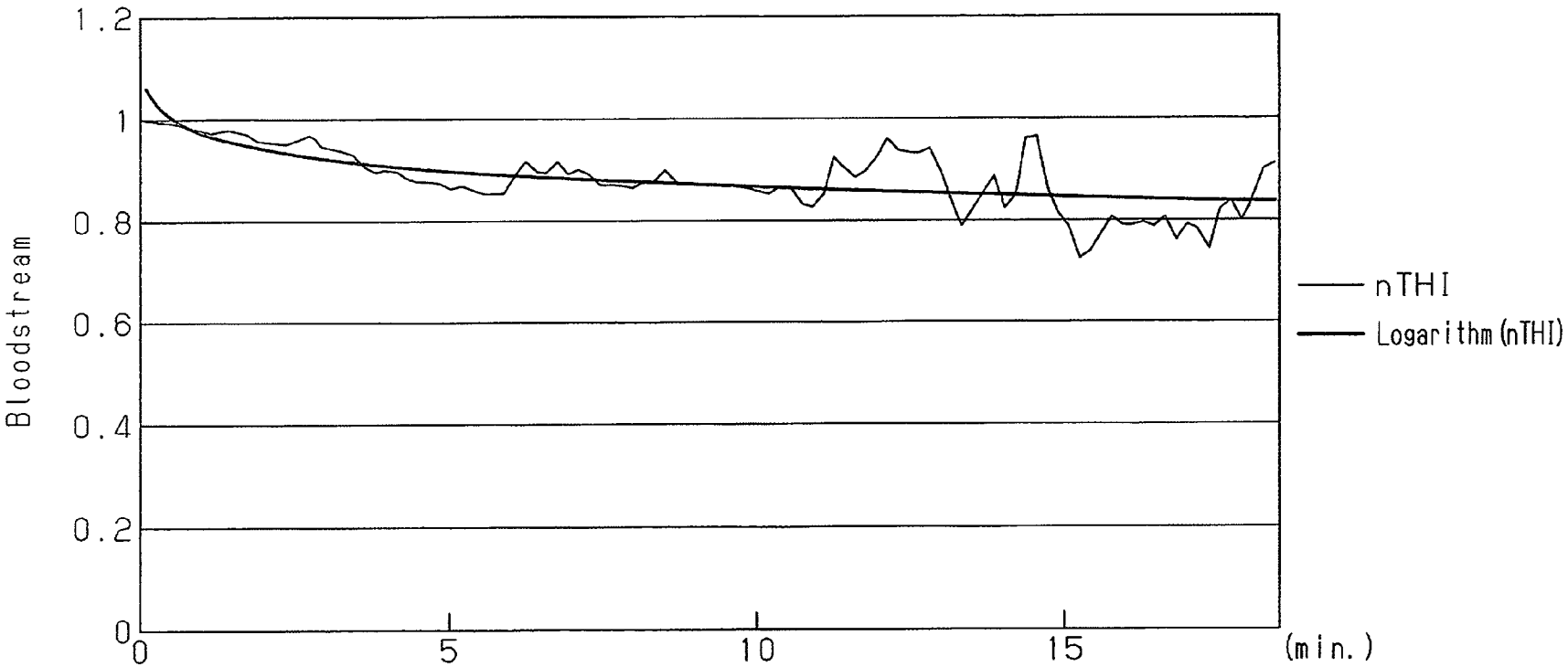
FIG. 12 is a graph showing the relationship between the elapsed time and the bloodstream when using a pillow of a comparative.
Figure 13:
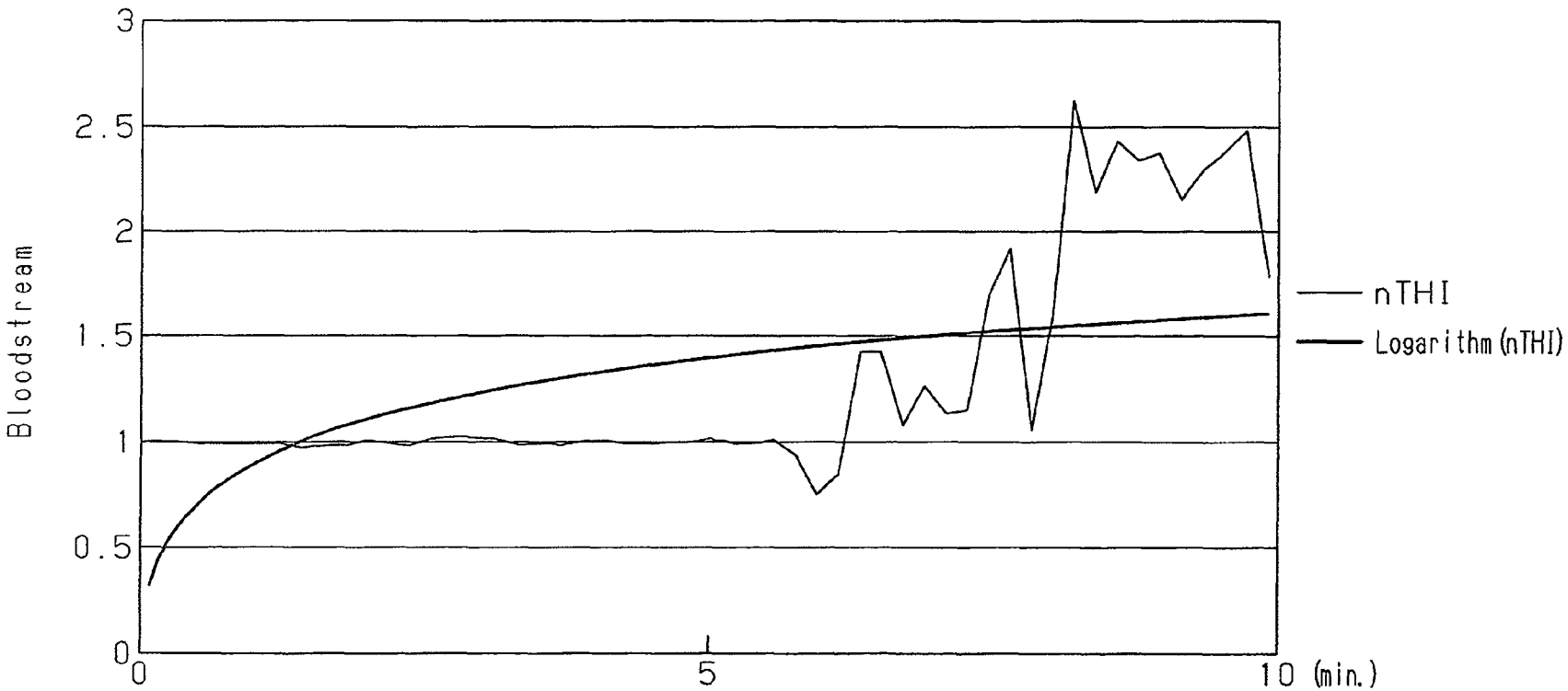
FIG. 13 is a graph showing the relationship between the elapsed time and the bloodstream when using a pillow of an example.

In FIGS. 12 and 13, each horizontal axis indicates the time and each vertical axis indicates the bloodstream. In FIG. 12, the undulated curve indicates the results when a subject used the prior art pillow for thirty minutes in a calm state and then the bloodstream was measured while the subject continuously used the pillow. This curve starts at "1" of the vertical axis representing the bloodstream and shows decreases and increases in the bloodstream. Further, in FIG. 12, the gradual curve is a logarithmic curve based on the undulated curve. As apparent from these curves, the bloodstream has a tendency of decreasing as time elapses and it has become understood that the bloodstream is decreased by about 17% after fifteen minutes.

After using the prior art pillow, the subject used the pillow 11 of the present embodiment for thirty minutes in a calm state and then the bloodstream was measured while the subject continuously used the pillow 11. This obtained the results indicated by the undulated curve shown in FIG. 13. In FIG. 13, the gradual curve is a logarithmic curve based on the undulated curve. As apparent from these curves, the bloodstream increases as time elapses and becomes about 1.5 times greater after eight minutes.

Although not shown by a graph, the bloodstream of a subject was measured when using a pillow formed from hard buckwheat hulls. It has become understood that in the same manner as when using the prior art pillow, the bloodstream has a tendency of decreasing as time elapses.

When the blood stream at the frontal lobe increases, the entire body becomes relaxed, and the bloodstream in the entire body is improved. Accordingly, it is considered that the pillow 11 of the present embodiment enables a relaxed and proper sleep in comparison to prior art pillows, such as a soft pillow or a hard pillow.

The present embodiment may be modified as described below.

Figure 14:
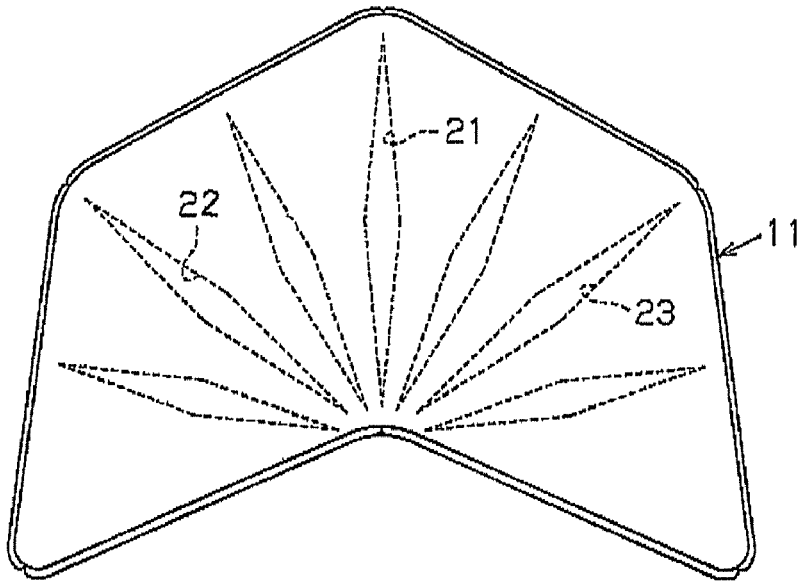
FIG. 14 is a front view showing a pillow according to a further embodiment.

As shown in FIG. 14, radial slits similar to the first to third slits 21 to 23 may be formed at, for example, seven or more locations.

Figures 15A, 15B, 15C:
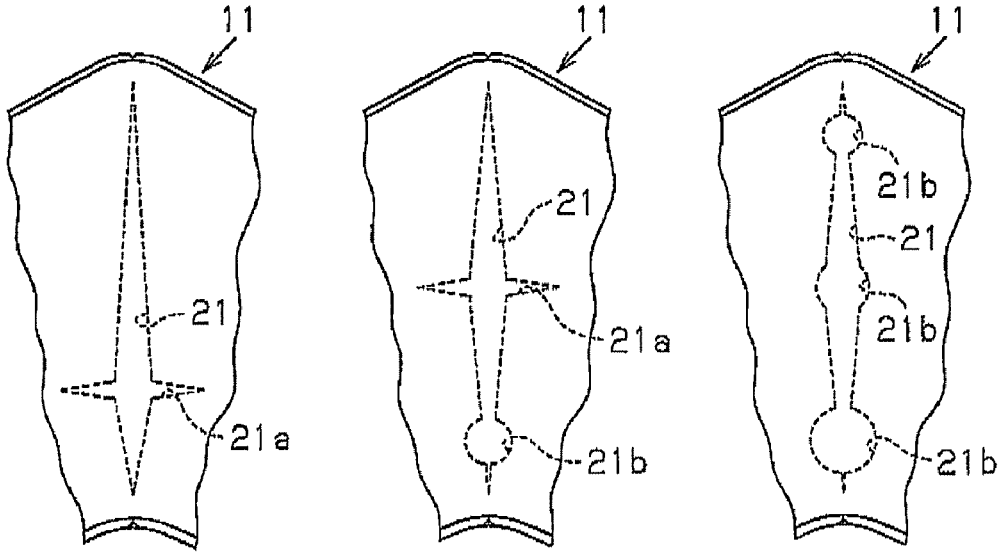
FIGS. 15(*a*) to 15(*c*) are front views showing first slits of different shapes.

As shown in FIG. 15(*a*), a wedge-shaped recess 21*a* may be formed by cutting intermediate portions of the first to third slits 21 to 23. As shown in FIG. 15(*b*), the recess 21*a* may be formed at the center of the first slit 21, and a circular recess 21*b* may be formed at the lower end of the first slit 21. Further, as shown in FIG. 15(*c*), the circular recesses 21*b* may be formed at three locations in the first slit 21.

In the present embodiment, the first to third slits 21 to 23 extend through the corresponding cushions in the vertical direction but do not have to extend through the corresponding cushions. In this case, the inner surfaces of the slits may be connected at the center in the thickness-wise direction of the pillow or at the lower end portion.

Although not shown in the drawings, the first cushion 15 having a thickness of, for example, 30 mm may be arranged at the lowermost portion, and a cushion made of a rubber foam body (e.g., rubber sponge) or a foam body of synthetic resin (e.g., urethane, polyurethane, polyolefin) and having a thickness of 10 mm may be stacked on the upper surface of the first cushion 15. Further, on the upper surface of the cushion, a cushion similar to the second cushion 16 and having a thickness of 20 mm may be stacked so that the pillow as a whole has a triple layer structure of cushions. The thickness of each cushion may be changed as required in accordance with the user. The cushioning characteristic differs between the front and rear sides of this pillow. Thus, the front and rear sides of the pillow may be reversed in accordance with user's conditions.

Although not shown in the drawings, pillows having different thicknesses may be used in a state stacked vertically.

Although not shown in the drawings, the second and third cushions 16 and 17 may be eliminated.

Although not shown in the drawings, when using material that is not breathable for the first cushion 15 of the pillow body 12, the material may be punched to form ventilation holes so that the pillow becomes breathable.

Although not shown in the drawings, the first cushion 15 may include a plurality of coiled springs oriented in the vertical direction and connected to one another in the horizontal direction.

What is claimed is:

1. A pillow comprising:

a pillow body including a flat cushion, the pillow body including a central portion defining a back head support and side head supports located on left and right sides of the back head support; and a flexible cover covering the surface of the pillow body;

wherein the pillow body includes a lower end face closer to a shoulder of a person that is supported by the pillow, the lower end face being formed to have a shape of a valley that is concave toward the back head support from the side head supports, thereby forming a shoulder contact;

wherein the pillow body includes an upper end face opposite to the lower end face, the upper end face being fowled to have a shape of a ridge that bulges toward the back head support from the side head supports;

wherein the back head support includes an elongated first slit and the side head supports respectively include an elongated second slit and an elongated third slit, the first to third slits extending radially from the proximity of the lower end face to the proximity of the upper end face so that the second and third slits are inclined relative to the first slit so as to be farther from the first slit as the second and third slits become closer to the upper end face; and wherein the first to third slits extend through the cushion, and rims of the slits are adapted to be compressed and deformed by the weight of the head of the person to stably support the head.

2. The pillow according to claim 1, wherein the cushion is made of a breathable high repulsion resilient material.

3. The pillow according to claim 1, wherein the first to third slits each have the shape of a flat diamond when viewed from above.

4. The pillow according to claim 1, comprising:

sub-cushions arranged between the upper surface of the cushion and the cover and between the lower surface of the cushion and the cover, wherein the sub-cushions have slits at locations corresponding to the first to third slits.

5. The pillow according to claim 4, wherein:

the cushion is selected from the group consisting of a mat formed from at least one type of a synthetic fiber selected from resilient polyester fibers, polyurethane fibers, polyethylene fibers, polypropylene fibers, and vinyl chloride fibers, a mat formed from resilient coconut hull fibers, a mat formed from natural fibers, a mix urethane foam, urethane foam, rubber sponge, and polyethylene sponge; and the sub-cushion is selected from a nonwoven fabric mat of felt, a foam body of natural rubber, a foam body of synthetic rubber, a foam body of natural resin, and a foam body of synthetic resin.

6. The pillow according to claim 1, wherein the first to third slits extend so as not to intersect with one another.

* * * * *